US011889878B2

(12) United States Patent
Calix

(10) Patent No.: US 11,889,878 B2
(45) Date of Patent: Feb. 6, 2024

(54) WIG GRIP

(71) Applicant: Nhatthuy Tran Calix, Covington, LA (US)

(72) Inventor: Nhatthuy Tran Calix, Covington, LA (US)

( * ) Notice: Subject to any disclaimer, the term of this patent is extended or adjusted under 35 U.S.C. 154(b) by 69 days.

(21) Appl. No.: 17/504,929

(22) Filed: Oct. 19, 2021

(65) Prior Publication Data

US 2022/0117340 A1 Apr. 21, 2022

Related U.S. Application Data

(60) Provisional application No. 63/093,532, filed on Oct. 19, 2020.

(51) Int. Cl.
*A41G 5/00* (2006.01)
*A41G 3/00* (2006.01)

(52) U.S. Cl.
CPC ..... *A41G 3/0033* (2013.01)

(58) Field of Classification Search
CPC ..... A45D 8/36; A41G 3/0033; A41G 3/0041; A41G 3/0091
See application file for complete search history.

(56) References Cited

U.S. PATENT DOCUMENTS 5,806,535 A * 9/1998 Becker ..... A41G 5/0093 132/54
2017/0258193 A1* 9/2017 Leo ..... A45D 8/16
2018/0109740 A1* 4/2018 Pickett ..... A61B 5/01
2020/0268083 A1* 8/2020 Gibson ..... A41G 3/0016

* cited by examiner

*Primary Examiner* — Rachel R Steitz
(74) *Attorney, Agent, or Firm* — Intellectual Property Consulting, LLC; Mark N. Melasky; Jared K. Rovira

(57) ABSTRACT

In accordance with embodiments of the invention, a wig grip is provided. The wig grip includes an elastomeric body having a hair contact side opposite a wig contact side and a first end opposite a second end. A plurality of hair attachment members disposed along the hair contact side of the elastomeric body. The hair attachment members are operable to attach to the hair of a user. A plurality of grip members is disposed along the wig contact side of the elastomeric body. The grip members are operable to engage and retain an underside of a wig. A fastener is operable to connect said first end of the elastomeric body to said second end of the elastomeric body.

17 Claims, 6 Drawing Sheets

WIG GRIP

CROSS-REFERENCE TO RELATED APPLICATIONS

This application claims priority to U.S. Provisional Patent Application Ser. No. 63/093,532 filed Oct. 19, 2021, the entirety of which is incorporated by reference as if fully disclosed herein.

BACKGROUND OF THE INVENTION

Field of the Invention

The present invention relates generally to grips for securing wigs.

General Background

Wigs are worn for a variety of reasons. Some users wear wigs to enable a change in hair style or color, while others wear wigs as a result of a medical condition adversely affecting the user's hair. Wigs are inherently heavy and are prone to slide or fall off. Wig grips are used to assist in securing a wig to a user's head. However, these are frequently hot and largely ineffective. Accordingly, there is a need for an improved wig grip.

SUMMARY OF THE INVENTION

In accordance with embodiments of the invention, a wig grip is provided. The wig grip includes an elastomeric body having a hair contact side opposite a wig contact side and a first end opposite a second end. A plurality of hair attachment members disposed along the hair contact side of the elastomeric body. The hair attachment members are operable to attach to the hair of a user. A plurality of grip members is disposed along the wig contact side of the elastomeric body. The grip members are operable to engage and retain an underside of a wig. A fastener is operable to connect said first end of the elastomeric body to said second end of the elastomeric body.

In accordance with embodiments of the invention, a wig grip is provided. The wig grip includes an elastomeric body having a hair contact side opposite a wig contact side. The body forms a loop. A plurality of hair attachment members is disposed along the hair contact side of the elastomeric body. The hair attachment members operable to attach to the hair of a user. A plurality of grip members is disposed along the wig contact side of the body. The grip members are operable to engage and retain an underside of a wig.

In accordance with embodiments of the invention, a wig grip is provided. The wig grip includes a body having a hair contact side opposite a wig contact side and a first end opposite a second end. A plurality of hair attachment members disposed along the hair contact side of the body. The hair attachment members are operable to attach to the hair of a user. A plurality of grip members is disposed along the wig contact side of the body. The grip members are operable to engage and retain an underside of a wig. A fastener is operable to connect said first end of the body to said second end of the body.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
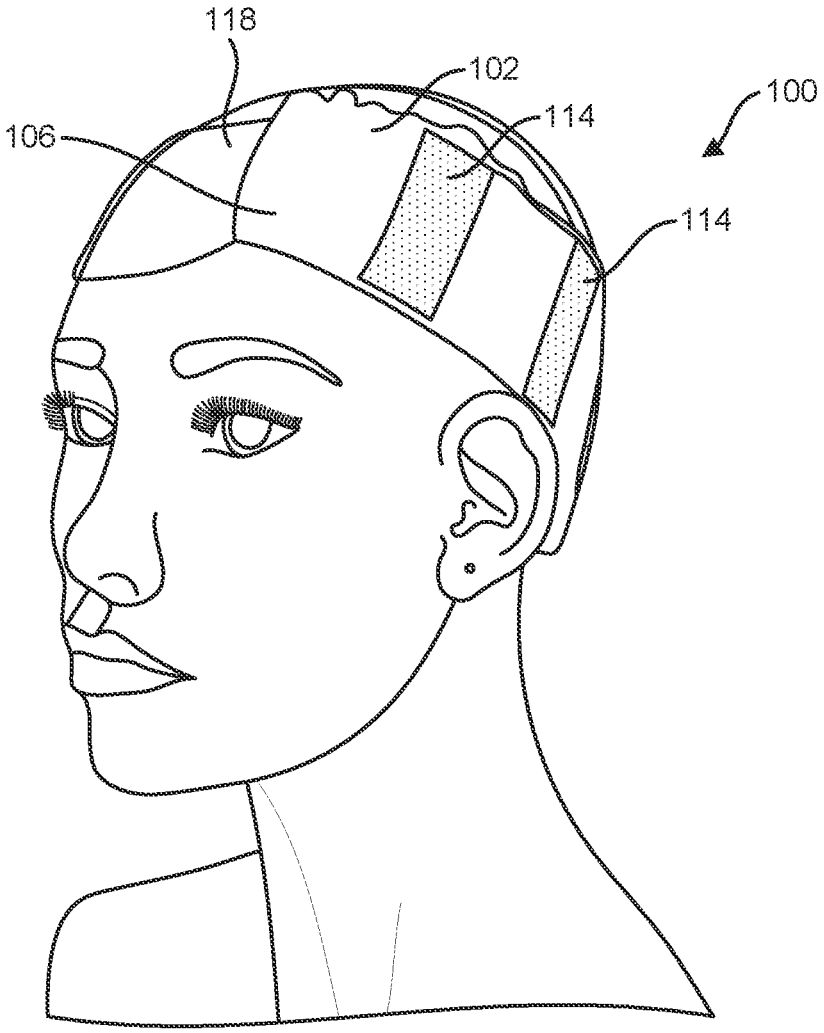
FIG. 1 depicts a front right perspective view of a wig grip in accordance with embodiments of the invention.
Figure 2:
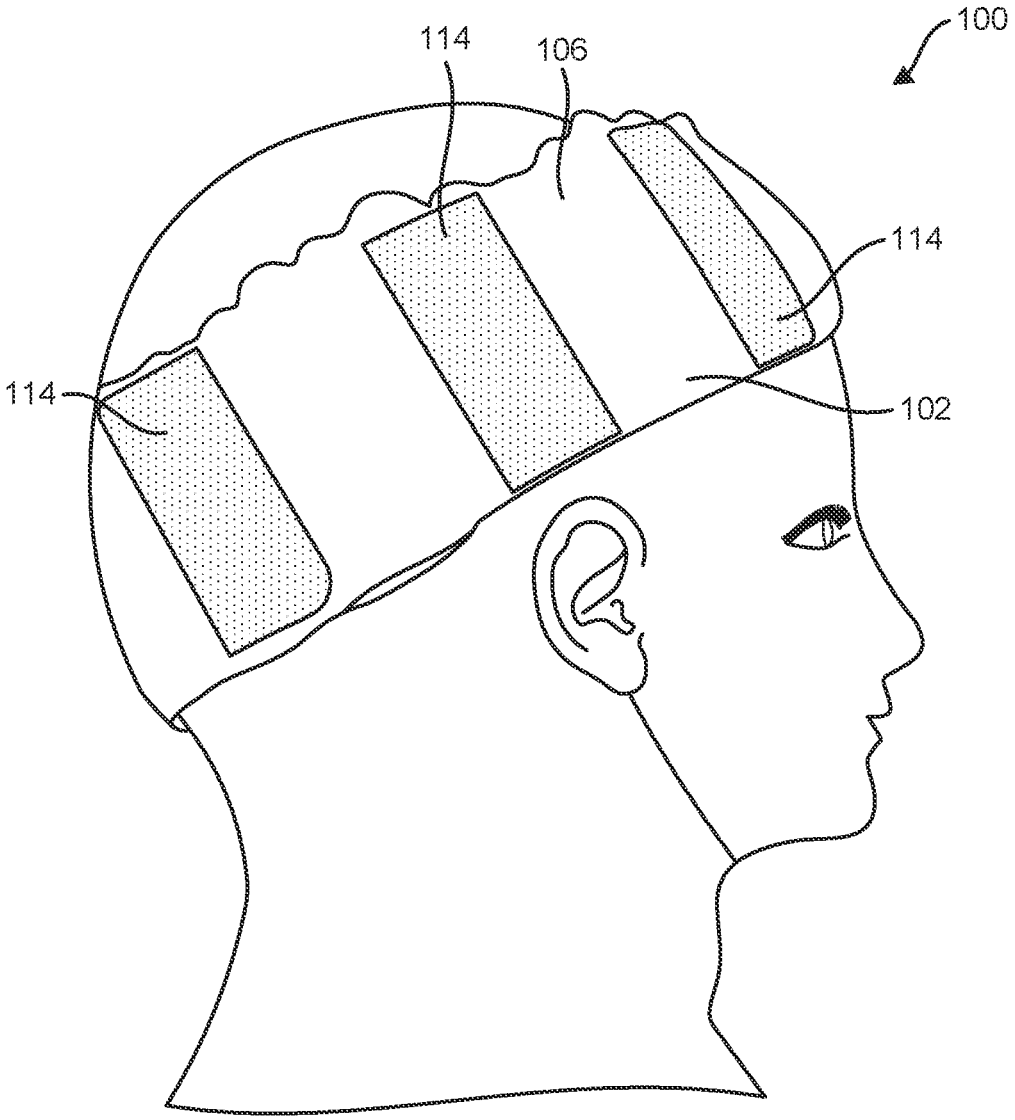
FIG. 2 depicts a back left perspective view of a wig grip in accordance with embodiments of the invention.
Figure 3:
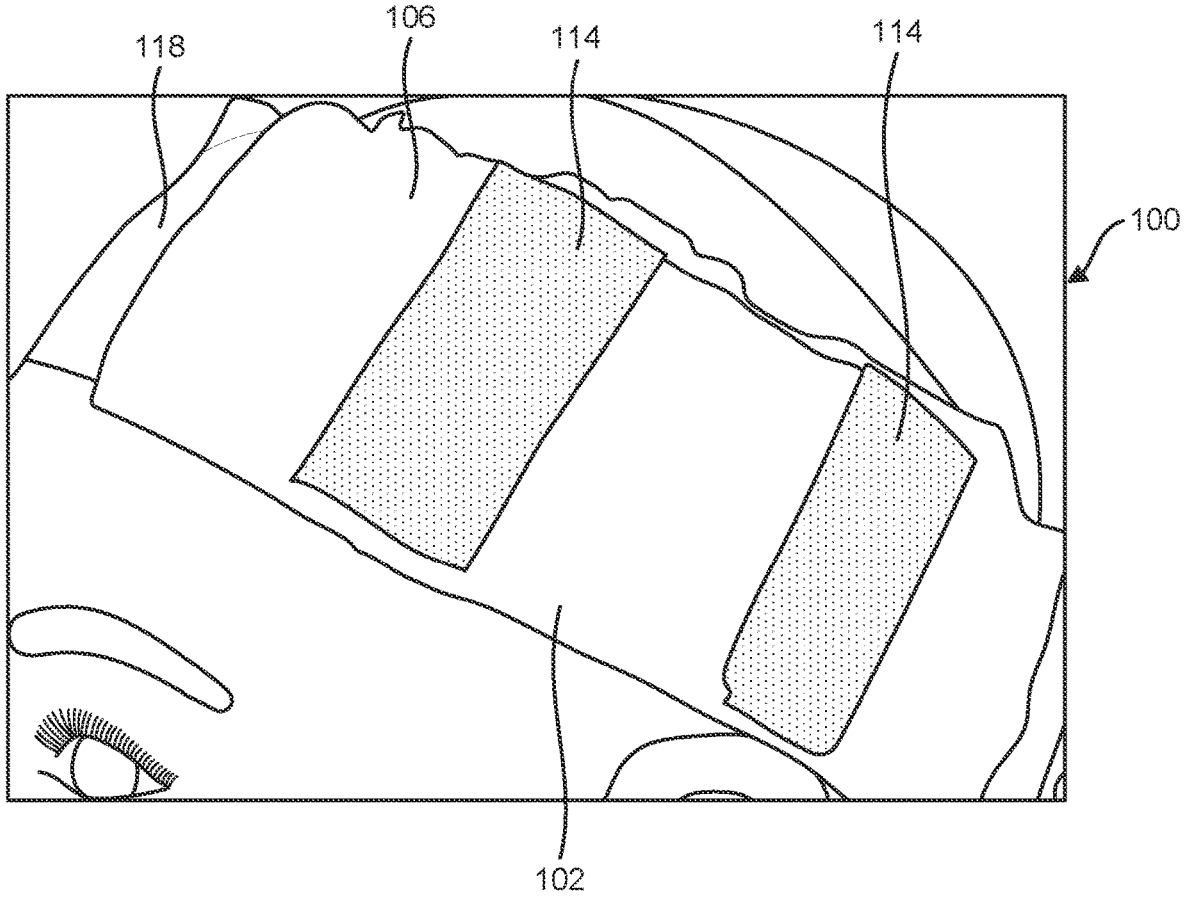
FIG. 3 depicts a close front right perspective view of a wig grip in accordance with embodiments of the invention.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

Figure 4:
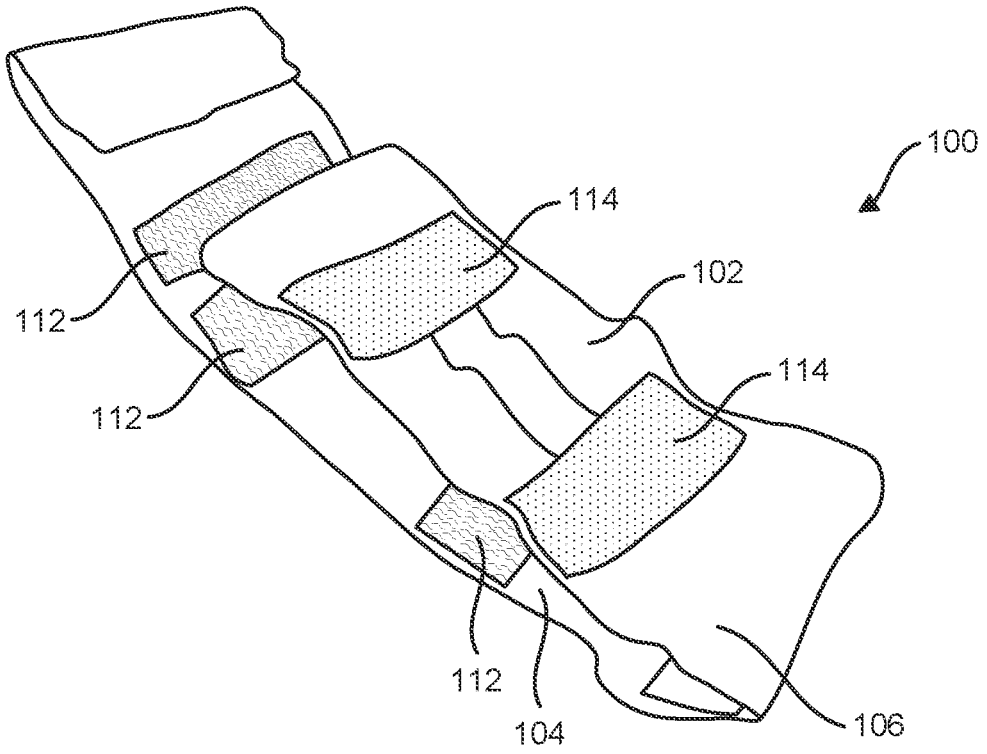
FIG. 4 depicts a top perspective view of a wig grip closed to form a loop in accordance with embodiments of the invention.
Figure 5:
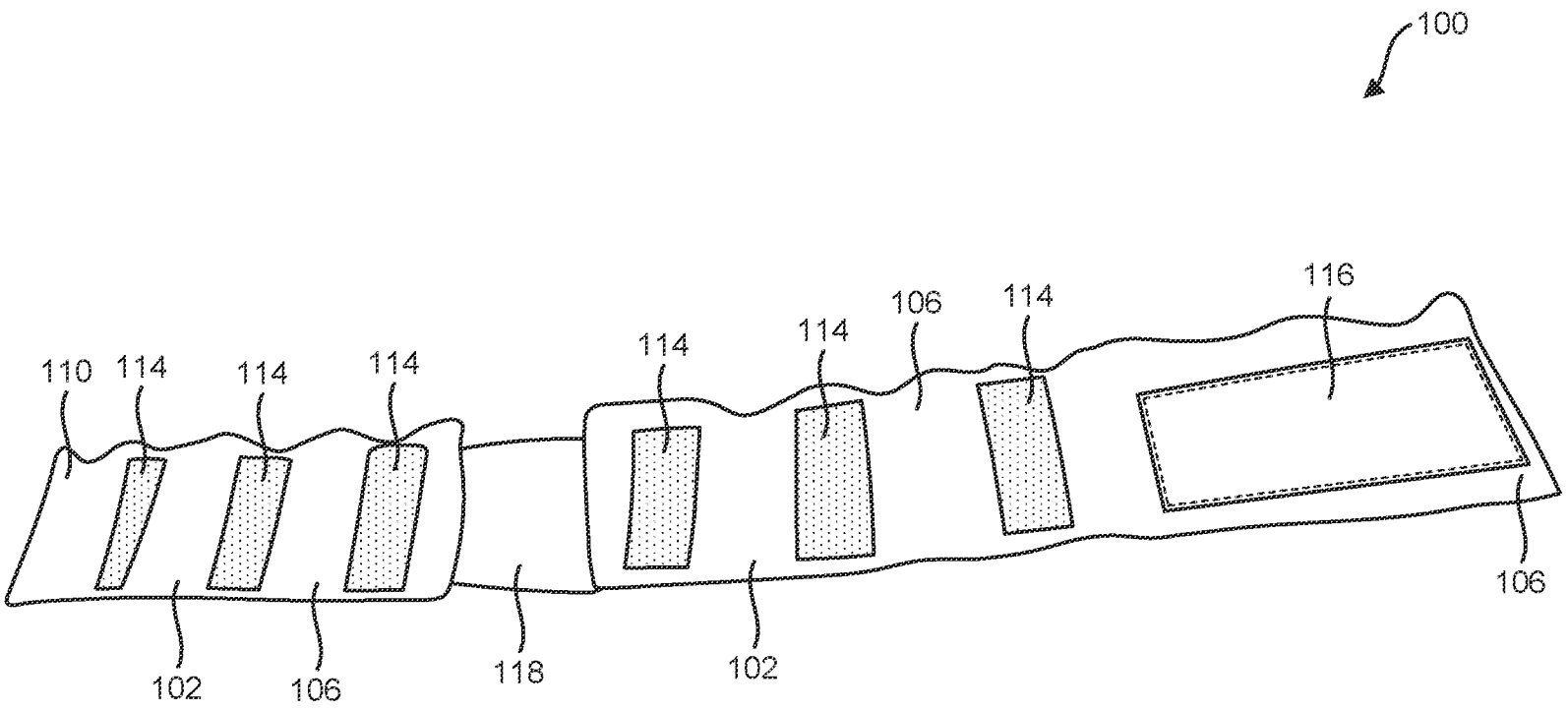
FIG. 5 depicts a top view of a wig contact side of a wig grip in accordance with embodiments of the invention.
Figure 6:
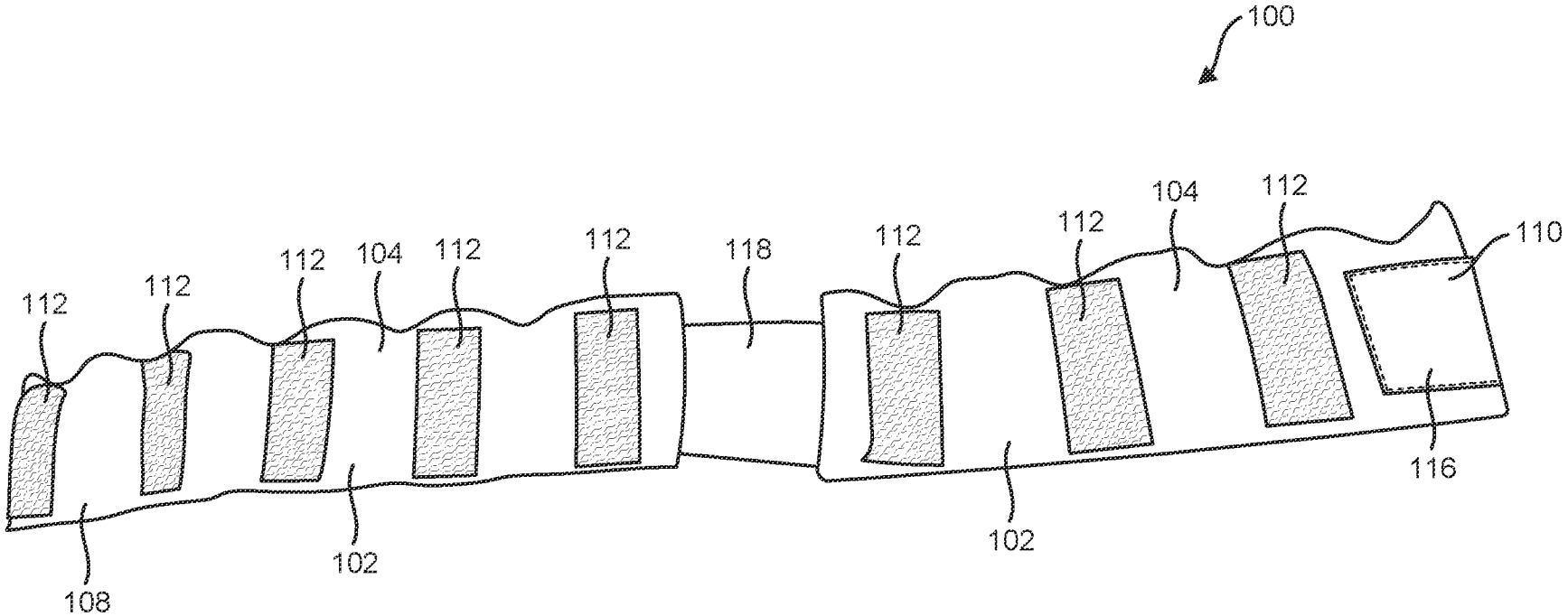
FIG. 6 depicts a top view of a hair contact side of a wig grip in accordance with embodiments of the invention.

In accordance with embodiments of the invention, a wig grip 100 is provided, as illustrated in FIGS. 1-6. The wig grip 100 includes an elastomeric body 102 having a hair contact side 104 opposite a wig contact side 106. The elastomeric body 102 has a first end 108 opposite a second end 110, as illustrated in FIGS. 5-6. In some embodiments, the elastomeric body 102 will form a continuous closed loop. A plurality of hair attachment members 112 is disposed along the hair contact side 104 of the elastomeric body 102 and operable to attach to the hair of a user, as illustrated in FIGS. 1-5. The plurality of hair attachment members 112 may be hook and loop strips, as illustrated in FIGS. 4 and 6 or any material suitable to be attached and removed from a user's hair. A plurality of grip members 114 is disposed along the wig contact side 106 of the elastomeric body 102 and is operable to engage and retain an underside of a wig. The plurality of grip members 114 may be silicon strips or any material operable to provide a sticky surface to engage and retain a wig. As illustrated in FIGS. 5-6, a fastener 116 is operable to connect the first end 108 of the elastomeric body 102 to the second end 110 of the elastomeric body 102. The fastener 116 may be hook and loop fasteners, hook and eye fasteners, or buttons, for example.

In one embodiment, as illustrated in the Figures, the elastomeric body 102 is fabricated from lace. In some embodiments, the elastomeric body 102 is fabricated from alternating sections of woven lace and transparent lace. The elasticity of the elastomeric body 102 enables a secure fit on the head of a user. The wig grip 100 is further adjustable by adjusting the point of contact of the fastener 116 to lengthen or shorten a loop formed by the elastomeric body 102. An elastomeric member 118 may be included to aid in elasticity of the wig grip 100. If elastomeric member 118 is included in a wig grip 100, the body 102 may or may not be made from an elastomeric material, depending on the application.

Embodiments of the wig grip 100 provide multiple advantages over the prior art. The plurality of hair attachment members 112 enable a secure yet releasable attachment to a user's hair. The plurality of grip members 114 enable a secure attachment to a wig by contacting the sticky surface of the grip member 114 to the underside of a wig. The fastener 116 enables a user to adjust the size of the wig grip 100 to account for the size of the user's head or to increase or decrease the fit around the user's head.

In one embodiment, the wig grip 100 measures 24 inches in length and 2.5 inches in width. The hair attachment members 112 measure 2.5 inches in length and 1 inch in width. The grip members 114 measure 2.5 inches in length and 1 inch in width. The attachment members 112 and grip members 114 may be placed at intervals along the respective sides of the body 102, as illustrated in the Figures.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A wig grip, comprising:

an elastomeric body, said elastomeric body having a hair contact side opposite a wig contact side, said elastomeric body having a first end opposite a second end, said elastomeric body having a length and a width;

a plurality of hook hair attachment members disposed along the hair contact side of the elastomeric body, said hook hair attachment members operable to attach to the hair of a user, each hook hair attachment member of said plurality of hook hair attachment members having a length and a width, and wherein said width of each hook hair attachment member is substantially equal to said width of said elastomeric body;

a plurality of grip members attached to an outer surface of the wig contact side of the elastomeric body, said grip members having a contact side opposite an attachment side, said contact side of said grip members fully exposed and operable to engage and retain an underside of a wig; and a fastener operable to connect said first end of the elastomeric body to said second end of the elastomeric body.

2. The wig grip of claim 1, wherein the elastomeric body is fabricated from lace.

3. The wig grip of claim 1, wherein the elastomeric body is fabricated from woven lace and transparent lace.

4. The wig grip of claim 1, wherein the elastomeric body is a continuous closed loop.

5. The wig grip of claim 1, wherein the plurality of grip members is silicon strips.

6. The wig grip of claim 1, wherein the fastener is hook and loop.

7. The wig grip of claim 1, further comprising an elastomeric member operable to provide elasticity to said elastomeric body.

8. The wig grip of claim 1, wherein the body is a continuous loop.

9. A wig grip, comprising:

an elastomeric body, said elastomeric body having a hair contact side opposite a wig contact side, said elastomeric body forming a continuous loop;

a plurality of hook hair attachment members disposed along the hair contact side of the elastomeric body, said hook hair attachment members operable to attach to the hair of a user; and a plurality of grip members attached to an outer surface of the wig contact side of the elastomeric body, said grip members having a contact side opposite an attachment side, said contact side of said grip members fully exposed and operable to engage and retain an underside of a wig.

10. The wig grip of claim 9, further comprising an elastomeric member operable to provide elasticity to said elastomeric body.

11. The wig grip of claim 9, wherein the plurality of grip members is silicon strips.

12. A wig grip, comprising:

a body, said body having a hair contact side opposite a wig contact side, said body having a first end opposite a second end;

a plurality of hook hair attachment members disposed along the hair contact side of the body, said plurality of hook hair attachment members operable to attach to the hair of a user;

a plurality of grip members attached to an outer surface of the wig contact side of the body, said grip members having a contact side opposite an attachment side, said contact side of said grip members fully exposed and operable to engage and retain an underside of a wig; and a fastener operable to connect said first end of the body to said second end of the body.

13. The wig grip of claim 12, wherein the body is fabricated from lace.

14. The wig grip of claim 12, wherein the body is fabricated from woven lace and transparent lace.

15. The wig grip of claim 12, wherein the plurality of grip members is silicon strips.

16. The wig grip of claim 12, wherein the fastener is hook and loop.

17. The wig grip of claim 12, further comprising an elastomeric member operable to provide elasticity to said body.

* * * * *